US009533775B1

(12) United States Patent
Willden et al.

(10) Patent No.: US 9,533,775 B1
(45) Date of Patent: Jan. 3, 2017

(54) PARTICLE PACKAGING SYSTEMS AND ASSOCIATED METHODS

(75) Inventors: C. Marcel Willden, Lehi, UT (US); Michael Paul Krummey, Saukville, WI (US)

(73) Assignee: MATRIX PACKAGING MACHINERY LLC, Saukville, WI (US)

( * ) Notice: Subject to any disclaimer, the term of this patent is extended or adjusted under 35 U.S.C. 154(b) by 2083 days.

(21) Appl. No.: 12/570,301

(22) Filed: Sep. 30, 2009

(51) Int. Cl.
*B65B 1/20* (2006.01)
*B65B 1/32* (2006.01)

(52) U.S. Cl.
CPC .. *B65B 1/20* (2013.01); *B65B 1/32* (2013.01)

(58) Field of Classification Search
USPC ..... 177/25.18; 141/10, 12, 71, 81, 83, 249
See application file for complete search history.

(56) References Cited

U.S. PATENT DOCUMENTS

| | | | | |
|---|---|---|---|---|
| 100,420 | A | 3/1870 | Ledmun | |
| 543,540 | A | 7/1895 | Sauer | |
| 2,781,955 | A | 2/1957 | Kidd | |
| 2,803,427 | A | 8/1957 | Wood | |
| 4,354,622 | A | 10/1982 | Wood | |
| 4,944,428 | A | 7/1990 | Gmur et al. | |
| 5,186,358 | A | 2/1993 | McVay | |
| 6,094,994 | A | 8/2000 | Satake et al. | |
| 6,605,785 | B1 | 8/2003 | Muramiya | |
| 6,806,429 | B2 | 10/2004 | Carlson | |
| 2001/0020553 | A1* | 9/2001 | Tamai | G01G 19/393 177/25.18 |
| 2009/0194558 | A1* | 8/2009 | Nakagawa | B65B 3/26 221/282 |

FOREIGN PATENT DOCUMENTS

| | | |
|---|---|---|
| EP | 0786648 | 7/1997 |

* cited by examiner

*Primary Examiner* — Jason K Niesz
(74) *Attorney, Agent, or Firm* — Thompson Hine LLP

(57) ABSTRACT

A high speed particle packaging machine comprises a weighing station, operable to weigh a cluster of particles. A densification station is positioned downstream of the weighing station and is operable to collect a cluster of particles recently released from the weighing station to densify the cluster of particles. The densification station includes an openable gate operable to instantaneously release the cluster of particles collected at the densification station. A bagging station is positioned downstream of the densification station and is operable to receive the densified cluster of particles after being released by the gate.

15 Claims, 4 Drawing Sheets

PARTICLE PACKAGING SYSTEMS AND ASSOCIATED METHODS

FIELD OF THE INVENTION

Background

The invention relates generally to the art of packaging machines. More particularly, the invention relates to systems and methods wherein pouches or bags are rapidly formed and filled vertically from a continuously or intermittently moving film material.

Related Art

Conventional vertical form, fill and seal continuous and intermittent pouch machines have been used for some time to vertically fill pouches with a variety of materials. Such machines generally receive a continuous film and form the film into a series of bags or pouches that are filled with goods during the formation process. Such machines can be configured as continuously fed machines (which move the film substantially continuously throughout the process) or intermittently fed machines (which periodically pause the process during the forming or filling process).

While many technological advances have been achieved to increase the rate at which such machines can fill bags or pouches, market forces continue to pressure providers of such machines to increase the fill rate capacity of such machines.

SUMMARY OF THE INVENTION

In accordance with one aspect, the present invention provides a high speed particle packaging machine, including a weighing station, operable to weigh a cluster of particles. A densification station can be positioned downstream of the weighing station and can be operable to collect a cluster of particles released from the weighing station to densify the cluster of particles. The densification station can include an openable gate operable to selectively and instantaneously release the cluster of particles collected at the densification station. A bagging station can be positioned downstream of the densification station and can be operable to receive the densified cluster of particles after being released by the gate.

In accordance with another aspect of the invention, a method of high-speed packaging of particles is provided, including: dividing a plurality of particles into one or more clusters of particles; weighing each cluster of particles with a weighing station; dispensing each cluster of particles from the weighing station into a densification station to densify the cluster of particles, the densification station being positioned downstream of the weighing station; actuating a gate of the densification station to instantaneously release the cluster of particles from the densification station to allow the cluster to flow downstream of the densification station; and bagging the cluster of particles with a bagging station positioned downstream of the densification.

In accordance with another aspect of the invention, a method of high-speed packaging of particles is provided, including: dividing a plurality of particles into one or more clusters of particles; weighing each cluster of particles with a weighing station; allowing each cluster of particles to freefall from the weighing station to a densification station; momentarily arresting the freefall motion of the cluster of particles at the densification station in order to densify the cluster of particles; actuating a gate of the densification station to instantaneously release the cluster of particles from the densification station to allow the cluster to freefall downstream; and bagging the cluster of particles with a bagging station positioned downstream of the densification station.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
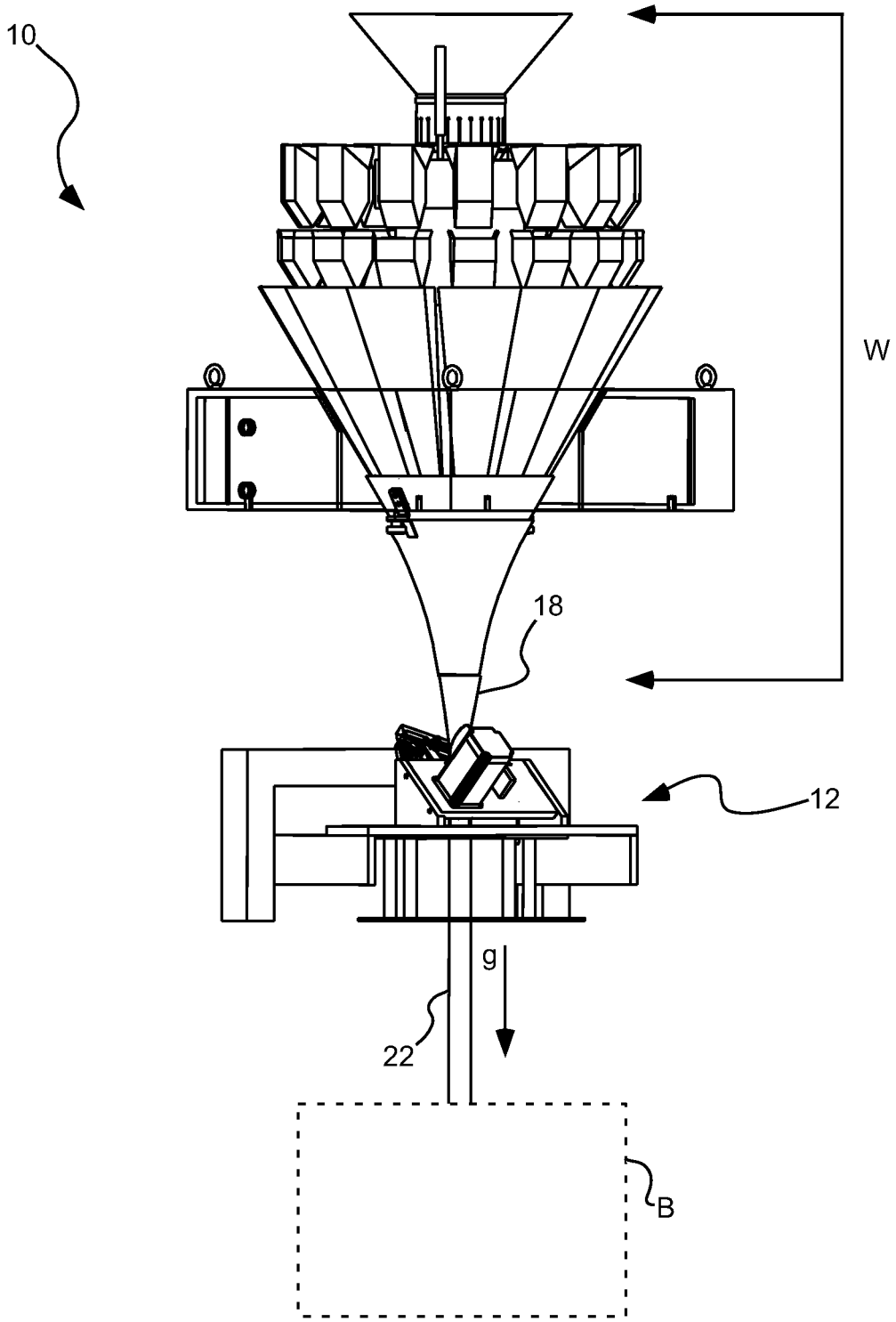
FIG. 1 is a perspective view of a packaging system in accordance with an embodiment of the present invention.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" can include plural referents, unless the context clearly dictates otherwise. Thus, for example, reference to a "particle" can, but does not necessarily, include one or more of such particles.

DEFINITIONS

In describing and claiming the present invention, the following terminology will be used in accordance with the definitions set forth below.

The technology described herein is adapted for use in filling bags or pouches with a variety of goods. The goods with which the present system can be utilized can vary widely. In many cases, however, the goods are, to one degree or another, in particulate form: e.g., a plurality of particles, units, pieces, items, etc., are collectively bagged into a pouch. As such, the discussion herein will focus on packaging of "particles," with that term being understood to broadly encompass a wide range of goods. Examples of such particles include, without limitation, pieces of candy, nuts, grains and the like.

Thus, the terms "particles" or "particulates," as used herein, are intended to encompass a variety of materials suitable for bagging with high speed filling systems, as will be appreciated by one of ordinary skill in the relevant art having possession of this disclosure.

When a group of particles is referenced herein as being "clustered," it is to be understood that the particles are grouped into relatively close vicinity with one another. A cluster of particles, as that term is used herein, is to be differentiated from a stream or large reservoir of particles.

As used herein, the term "densify" is to be understood to refer to a process in which a given number of particles within a cluster of particles is made to exist within a smaller volume than that in which they existed prior to densification. In other words, a given number of particles will be more tightly "packed" or "grouped" relative to one another after the densification process.

Flow patterns of particles can be referenced herein as either continuous or noncontinuous. An example of a continuous flow pattern occurs when a plurality of particles fall as a more or less continuous stream of particles from one elevation to a lower elevation. An example of a noncontinuous flow pattern occurs when some structure releases a cluster of particles into motion, and then interrupts or halts the release of further particles until the initial cluster has moved some distance. Thus, a noncontinuous flow pattern of particles exhibits "breaks" or "disconnects" between adjacent clusters of particles.

As used herein, the term "uninterrupted path" is to be understood to refer to a flow path that includes no structural components within the flow path that interfere with, or contact, particles moving along or in the path. One example of an uninterrupted flow path would be a free-fall flow path, wherein particles make no contact with any structure as they fall through an open airspace. In some embodiments of the invention, an uninterrupted flow path can be provided by a tubular structure or chute that includes vertical walls that do no encroach into the flow path within the tubular structure or chute. One example of a flow path that would not be considered uninterrupted, as that term is used herein, is a funnel-shaped collector: as the flow path of particles falling into such a funnel is clearly affected and/or altered by the sloped walls of the funnel.

As used herein, the term "substantially" refers to the complete or nearly complete extent or degree of an action, characteristic, property, state, structure, item, or result. As an arbitrary example, an object that is "substantially" translucent is an object that is either completely translucent or nearly completely translucent. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or nearly complete lack of an action, characteristic, property, state, structure, item, or result. As an arbitrary example, a composition that is "substantially free of" an ingredient or element may still actually contain such ingredient or element so long as there is no measurable effect as a result thereof.

Distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also to include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value and should apply regardless of the breadth of the range or the characteristics being described.

INVENTION

The present invention relates generally to packaging machines that form, fill and seal pouches using generally large sheets or rolls of film material as raw material. While such machines are often used to create discrete packages of dry goods, such as coffee beans, candies, nuts and the like, they can also be used to package powdered goods, liquid goods, etc. In most cases, the present invention will be most suitably applied to vertical form, fill and seal machines, which create a tube from a sheet or roll of film that travels (and is formed and filled) vertically. While the present system is shown in use with a vertical form, fill and seal system, it is to be understood that the inventive concepts can be readily incorporated into a horizontal form, fill and seal system, as well as other configurations known to those of skill in the art.

In one aspect of the invention, the present invention provides a high speed particle packaging machine, shown generally at 10 in FIG. 1. The overall system includes several sub-components, including a weighing station "W" that can be operable to weigh one or more (and typically many hundreds of) clusters of individual particles. The system can also include a densification station 12 that is typically positioned downstream of the weighing station. The densification station is operable to collect a cluster of particles released from the weighing station to densify the cluster of particles, as will be discussed in further detail below.

As shown in FIGS. 2-4B, the densification station 12 can include a gate 14 that is functional to open and close in order to control the flow of particles (and/or clusters of particles) through the densification station. The gate is generally openable to selectively and instantaneously release the cluster of particles collected at the densification station to allow the cluster to flow downstream to a bagging station ("B" in FIG. 1) that is typically positioned downstream of the densification station. The bagging station is operable to receive the densified cluster of particles after being released by the gate.

The present system can be readily adapted for use with a variety of known packaging system components. For example, both the weighing station "W" and the bagging station "B" can be systems that are well known to those in the field of such endeavors. For purposes of the present disclosure, it will be assumed that the reader is familiar with such systems and the present discussion will focus primarily on the operation and various components of the densification station or system 12.

Similarly, one of ordinary skill in the art will appreciate that the various components of the present invention require a great deal of controlling hardware, software, circuitry, computer interfaces, etc. As the use and operation of such components is well known, detailed descriptions of them will not be provided herein.

As will be appreciated from FIG. 1, generally speaking, a cluster of particles enters the densification station 12 after leaving tapered chute 18 of the weighing system "W." Once processed by the densification system, the cluster of particles enters or travels to the bagging station or system "B" via chute 22. Once received by the bagging station, the cluster of particles is typically bagged, sealed and otherwise readied for distribution as a finished product.

Figure 2:
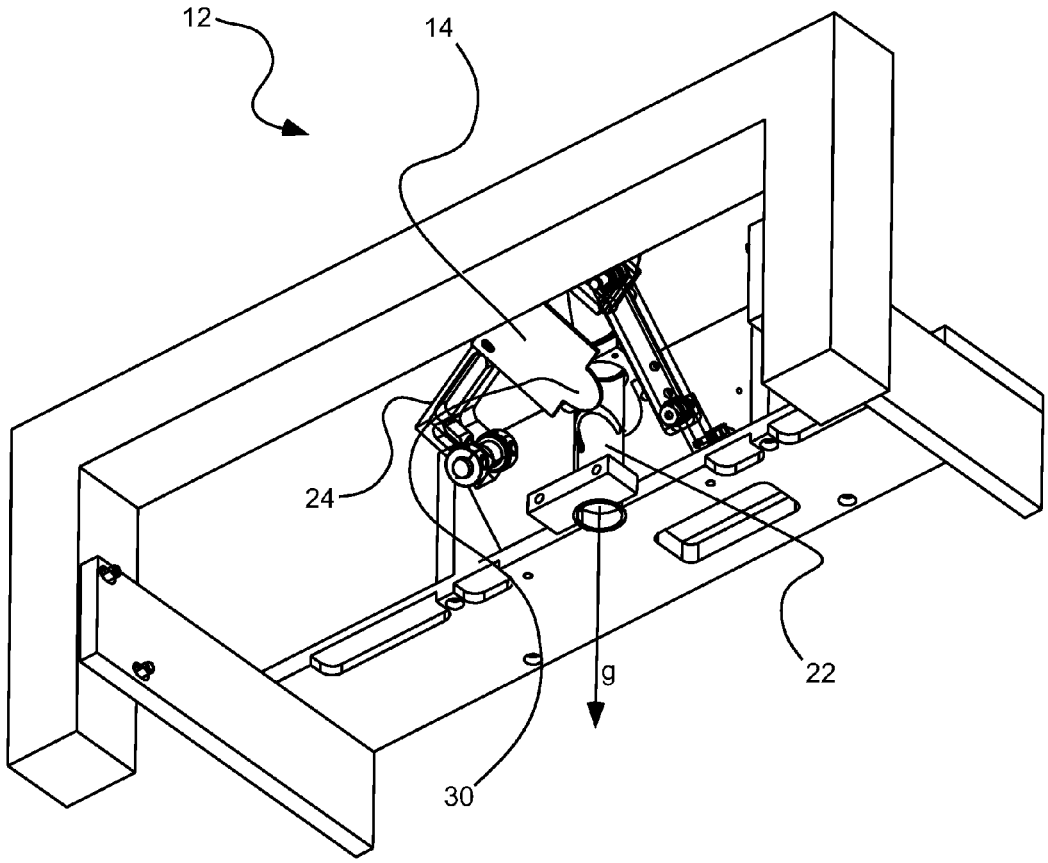
FIG. 2 is a lower, perspective view of portions of a densification station in accordance with an embodiment of the invention, with a gate of the densification station shown in an open configuration.
Figure 3:
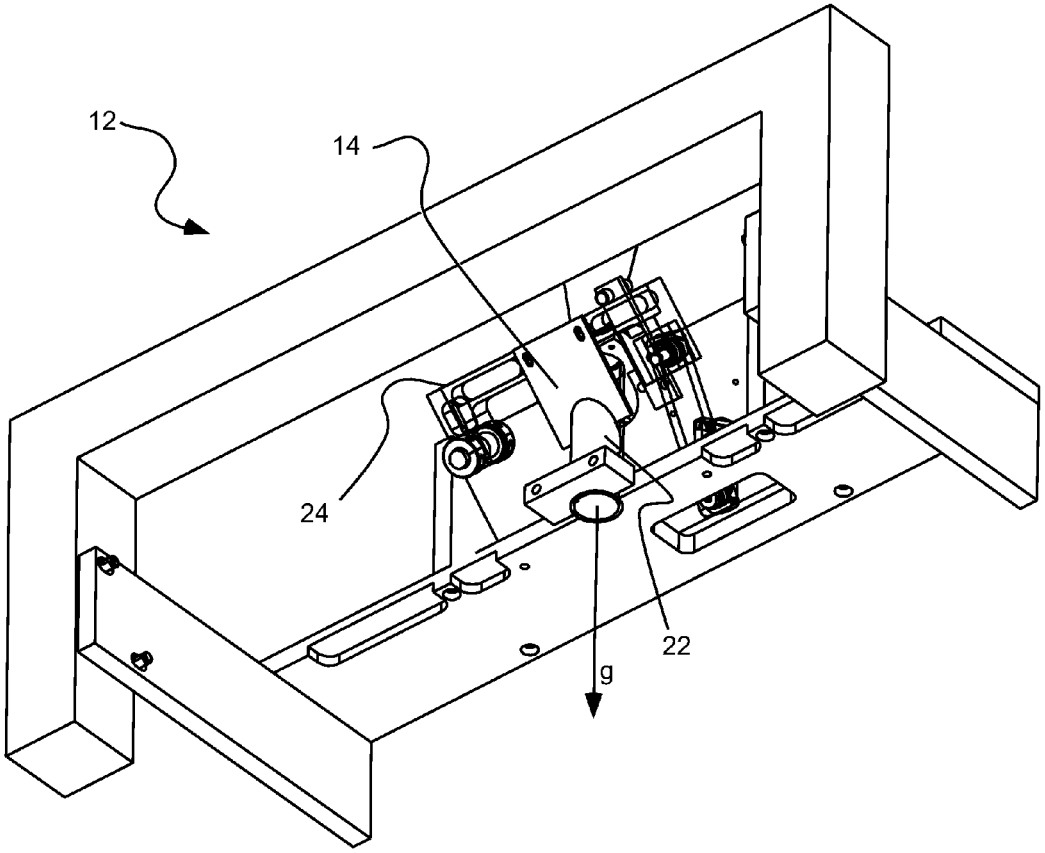
FIG. 3 is a lower, perspective view of the portions of the densification station of FIG. 2, with the gate of the densification station shown in a closed configuration.
Figure 4A:
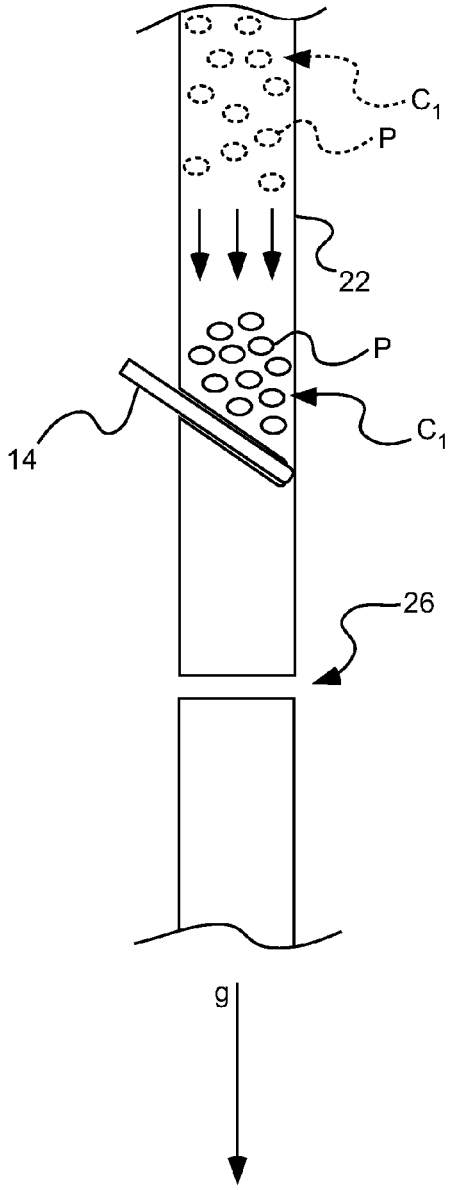
FIG. 4A is a schematic representation of a flow of a cluster of particles through a chute of a densification station in accordance with an embodiment of the invention.
Figure 4B:
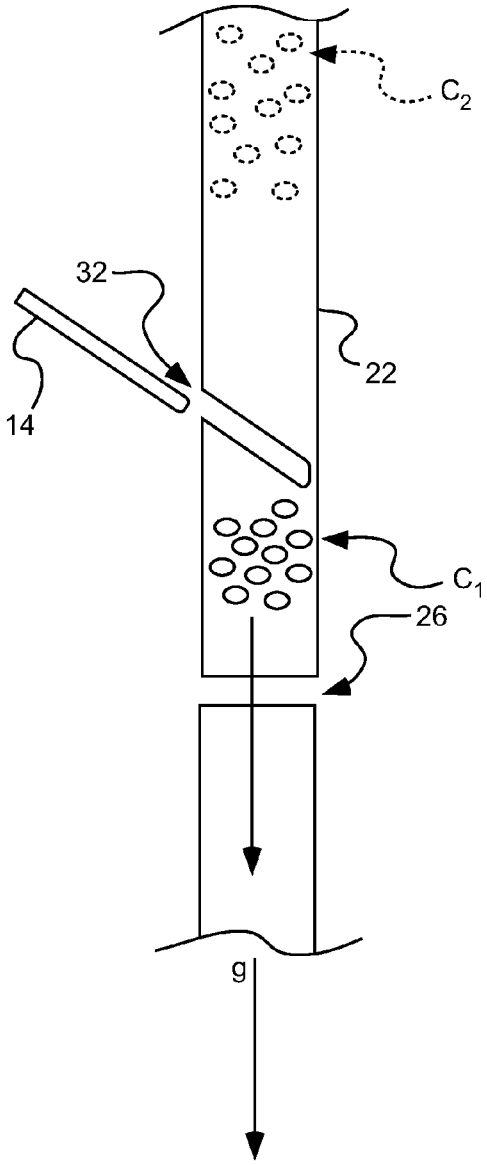
FIG. 4B is a schematic representation of the flow of the cluster of particles of FIG. 4A, shown after the cluster has been released from a gate of the densification station.

As shown in FIGS. 2-4B, the densification station 12 can include chute 22 through which the clusters of particles flow during operation of the system. Gate 14 is associated with the chute 22 and is selectively operable to be closed to either stop or pause the flow of particles (or clusters of particles) through the chute; or to be opened to allow the flow of particles through the chute. While the gate can be actuated in a number of manners, in the embodiment shown it is coupled to a swing arm 24. The swing arm is controllable to be oriented into a closed position, as shown in FIG. 3 and FIG. 4A, and an open position, as shown in FIG. 2 and FIG. 4B. When in the open position, the cluster of particles is free to move down the chute 22 and toward or into the bagging station B.

While not so required, the system can be oriented such that the flow path of the particles coincides with the gravity vector "g," as shown in FIGS. 2-4B. Thus, the primary force causing flow of the clusters of particles is the natural downward gravitational force. This force propels a cluster of particles from the chute 18 of the weighing station "W" after the cluster has been weighed (or divided into a cluster based on weight). As the cluster exits the chute 18, it enters chute 22 of the densification station 12.

As shown schematically in FIG. 4A, the cluster $C_1$ of particles P is typically flowing in a loosely packed, turbulent (or at least non-streamlined) manner as it exits the weighing station W (not seen in this figure). In conventional systems, the cluster is simply allowed to continue its descent from the weighing station until it enters the bagging station. However, during this descent, the initial turbulent, loosely packed cluster can, and often does, become more loosely packed and diffused the further the cluster travels through the air.

This turbulent, diffuse relationship of the particles can be the result of collisions between the particles and various structures encountered during movement through the weighing station. As a result of this non-streamlined flow, a sometimes significant amount of time may pass before all of the particles of a cluster become positioned within a bag so that the bag can be sealed and the system can begin processing the next bag, pouch or package. In other words, it has been required in the past to slow the bagging system or station in order to allow the bags or pouches to be filled before moving on to processing of the next bag or pouch.

The present inventors have found that densifying the cluster of particles prior to further processing and/or bagging of the particles can significantly increase the throughput of bags or pouches (e.g., significantly decrease the processing time required for each bag or pouch). As shown in FIG. 4A, as the diffused cluster $C_1$ enters chute 22, the particles are loosely packed and are likely flowing downwardly in a non-streamlined manner. Gate 14 is closed within the chute 22, however, and causes the cluster $C_1$ to at least momentarily stop flowing or falling, resulting in a more closely packed or densified cluster.

After an appropriate amount of time has passed, gate 14 can be very rapidly (e.g., instantaneously, or nearly instantaneously) opened into the position shown in FIG. 4B (and associated FIG. 2). Once rapidly opened, the cluster of particles $C_1$ will fall through the chute 22 as a densely packed group flowing in a streamlined manner. In this manner, the cluster can travel very quickly to a bag or pouch in the bagging station, and the bagging station need not be slowed to wait for bags to be filled. As illustrated in FIG. 4B, at the time when cluster $C_1$ has been released, cluster $C_2$ can already be falling toward the gate 14, which can close immediately after releasing cluster $C_1$ in order to stop or gather cluster $C_2$. The process can then be repeated many times over in order to process large quantities of particles.

While the gate opening speed, and the amount of time the gate spends closed to densify the particles, can vary, in one embodiment the gate is closed on the order of 150-200 ms (milliseconds). In other embodiments, this gate closure time can vary from 50 ms to 400 ms.

While not so required, in one embodiment of the invention, the chute 22 can include a vent opening 26 that can be formed below the gate and can aid in providing streamlined flow of the clusters of particles through the chute and toward the bagging station. While vent opening 26 is shown in FIGS. 4A and 4B as completely circumventing the chute, it is to be understood that the opening may only partially circumvent the chute; or may be configured as a series of slots, etc.

In the embodiments shown in the figures, the clusters of particles follow a substantially uninterrupted downstream path from the densification station 12 to the bagging station "B," which can include no impeding physical structure between the gate and the bagging station. The absence of impeding physical structure can limit the amount of turbulence generated or experienced by the cluster of particles as the particles travel along the flow path.

In one aspect of the invention, the gate 14 can be oriented at an oblique angle relative to a flow path of the cluster of particles, as best appreciated from FIGS. 4A and 4B. The inventors have found that forming the gate at such an angle can aid in very quickly releasing the cluster of particles without imparting undue lateral motion to the particles. As best appreciated from FIG. 2, the gate can include protrusion 30 that is shaped to fit within a slot 32 of the chute 22 (see also FIGS. 4A and 4B). The protrusion can be shaped to correspond to a shape of an inside curvature of the chute.

Various methods of packaging of particles are also provided by the present invention. In one embodiment, a method of high-speed packaging of particles is provided, and can include dividing a plurality of particles into one or more clusters of particles and weighing each cluster of particles with a weighing station. After weighing, the cluster of particles can be dispensed from the weighing station into a densification station to densify the cluster of particles. The densification station is typically positioned downstream of the weighing station. While not so required, a "downstream" path of particles often corresponds to the gravity vector. The method can include actuating a gate of the densification station to instantaneously release the cluster of particles from the densification station to allow the cluster to flow downstream of the densification station. Finally, the cluster of particles can be bagged with a bagging station positioned downstream of the densification.

In accordance with another aspect of the invention, a method of high-speed packaging of particles is provided, and can include dividing a plurality of particles into one or more clusters of particles and weighing each cluster of particles with a weighing station. Each of the clusters of particles can be allowed to freefall from the weighing station to a densification station. The densification station can momentarily arrest the freefall motion of the cluster of particles in order to densify the cluster of particles. A gate of the densification station can be actuated to instantaneously release the cluster of particles from the densification station to allow the cluster to freefall downstream. The cluster of particles can be bagged with a bagging station positioned downstream of the densification station.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

We claim:

1. A high speed particle packaging machine, comprising:

a weighing station, operable to weigh a cluster of particles;

a densification station, positioned downstream of the weighing station and being operable to collect a cluster of particles released from the weighing station to densify the cluster of particles;

the densification station including an openable gate operable to selectively and instantaneously release the cluster of particles collected at the densification station; and a bagging station, positioned downstream of the densification station and being operable to receive the densified cluster of particles after being released by the gate;

wherein the densification station includes a chute having a channel formed therein and extending downward from the gate toward the bagging station, the chute defined by a vertical wall;

wherein the cluster of particles follows an uninterrupted downstream path from the densification station to the bagging station and the chute has a vent opening therein between the gate and the bagging station.

2. The machine of claim 1, wherein the downstream path includes no impeding physical structure between the gate and the bagging station.

3. The machine of claim 1, wherein the weighing station releases the cluster of particles in a noncontinuous flow pattern.

4. The machine of claim 1, wherein the particles move from the weighing station, through the densification station and to the bagging station along a substantially vertical flow path aligned with the gravity vector.

5. The machine of claim 1, wherein the gate is oriented at an oblique angle relative to a flow path of the cluster of particles.

6. The machine of claim 5, wherein the gate is configured to open and close along a plane oriented at an oblique angle relative to the flow path of the cluster of particles.

7. A high speed particle packaging machine, comprising:

a weighing station, operable to weigh a cluster of particles;

a densification station, positioned downstream of the weighing station and being operable to collect a cluster of particles released from the weighing station to densify the cluster of particles;

the densification station including an openable gate operable to selectively and instantaneously release the cluster of particles collected at the densification station; and a bagging station, positioned downstream of the densification station and being operable to receive the densified cluster of particles after being released by the gate wherein the densification station includes a chute having a channel formed therein, and wherein at least a portion of the gate fits within the channel to cause the cluster of particles to collect within the chute;

wherein the gate includes a protrusion having a shape that corresponds to an inside curvature of the chute.

8. A method of high-speed packaging of particles, comprising:

dividing a plurality of particles into one or more clusters of particles;

weighing each cluster of particles with a weighing station;

dispensing each cluster of particles from the weighing station into a densification station to densify the cluster of particles, the densification station being positioned downstream of the weighing station;

actuating a gate of the densification station to instantaneously release the cluster of particles from the densification station to allow the cluster to flow downstream of the densification station; and bagging the cluster of particles with a bagging station positioned downstream of the densification; and wherein the cluster of particles follows an uninterrupted downstream path from the densification station into a bag at the bagging station.

9. The method of claim 8, wherein actuating the gate includes actuating the gate along a plane that is oriented at an oblique angle relative to a flow path of the cluster of particles.

10. The method of claim 8, wherein the downstream path includes no impeding physical structure between the gate and the bag at the bagging station.

11. The method of claim 8, wherein the weighing station dispenses the cluster of particles in a noncontinuous flow pattern.

12. The method of claim 8, wherein the cluster of particles moves from the weighing station, through the densification station and to the bagging station along a substantially vertical path aligned with the gravity vector.

13. A method of high-speed packaging of particles, comprising:

dividing a plurality of particles into one or more clusters of particles;

weighing each cluster of particles with a weighing station;

allowing each cluster of particles to fall from the weighing station to a densification station;

momentarily arresting the cluster of particles densification station in order to densify the cluster of particles;

actuating a gate of the densification station to instantaneously release the cluster of particles from the densification station to allow the cluster to freefall downstream; and bagging the cluster of particles with a bagging station positioned downstream of the densification station;

wherein the cluster of particles follows an uninterrupted downstream path from the densification station to the bagging station.

14. The method of claim 13, wherein actuating the gate includes actuating the gate along a plane that is oriented at an oblique angle relative to a flow path of the cluster of particles.

15. The method of claim 13, wherein the downstream path includes no impeding physical structure between the gate and the bagging station.

* * * * *